US007136499B2

(12) United States Patent
Kondo

(10) Patent No.: US 7,136,499 B2
(45) Date of Patent: Nov. 14, 2006

(54) SURFACE-PLACED SOUND CAPTURING MICROPHONE WITH ROTATABLE CABLE CONNECTING MEMBER

(75) Inventor: Kazuhisa Kondo, Tokyo (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 0 days.

(21) Appl. No.: 10/983,206

(22) Filed: Nov. 5, 2004

(65) Prior Publication Data

US 2005/0117769 A1 Jun. 2, 2005

(30) Foreign Application Priority Data

Dec. 1, 2003 (JP) ..... 2003-401666

(51) Int. Cl.
*H04R 25/00* (2006.01)

(52) U.S. Cl. ..... 381/361; 381/355; 381/358

(58) Field of Classification Search ..... 381/122, 381/355–358, 361–368; 181/158, 150, 153
See application file for complete search history.

(56) References Cited

U.S. PATENT DOCUMENTS 3,324,254 A * 6/1967 Shaw et al. ..... 381/363
4,569,077 A * 2/1986 Marinelli ..... 381/113
5,898,789 A * 4/1999 Nichols et al. ..... 381/361
6,226,386 B1 * 5/2001 Akino ..... 381/173
6,671,382 B1 * 12/2003 Chen ..... 381/355
6,711,272 B1 * 3/2004 Rodgers ..... 381/363

FOREIGN PATENT DOCUMENTS

JP 2515812 10/1996

* cited by examiner

*Primary Examiner*—Suhan Ni
(74) *Attorney, Agent, or Firm*—Welsh & Katz, Ltd.

(57) ABSTRACT

The subject invention provides a surface-placed a surface sound capturing microphone with a rotatable cable connecting member to allow the output cable extracted position to be simply changed. A surface-placed sound capturing microphone of the subject invention includes a connecting member 2 which connects one end of an output cable 3 for transferring an audio signal captured by a microphone capsule to a predetermined external instrument. The connecting member 2 is mounted in the microphone case 11 and is rotatable around a horizontal rotating shaft in parallel to the placed surface. The output cable of the microphone can be positioned at a horizontal extracted position where the cable is horizontally extracted in parallel to the placed surface and at a vertical extracted position where the cable is vertically extracted relating to the placed surface.

8 Claims, 6 Drawing Sheets

SURFACE-PLACED SOUND CAPTURING MICROPHONE WITH ROTATABLE CABLE CONNECTING MEMBER

FIELD OF THE INVENTION

The present invention relates to a surface-placed sound capturing microphone including a low profile microphone case placed on a horizontal surface such as a table. The invention especially relates to the surface-placed sound capturing microphone with an extracted direction of an output cable connected to the microphone changing.

BACKGROUND OF THE INVENTION

One of desk-top microphones which are used on a table in a conference room or a TV studio is a surface-placed sound capturing microphone. As shown in Japanese Utility Model Registration No. 2515812, the surface-placed sound capturing microphone is called a boundary microphone or a surface-mounted microphone. A low profile microphone case of the microphone is placed on a plane surface such as a table.

The height of a microphone case of the microphone of this kind is low so that the microphone is indistinct and good-looking on TV compared with other desk-top microphones, even if the microphone is placed on a table.

However, the surface-placed sound capturing microphone has a major problem to be solved. An extracted position of a microphone output cable in the microphone of this kind is generally mounted in the back side of the microphone case and the extracted direction is only one direction where is parallel to a placed surface.

Therefore, since one part of the output cable is exposed to the table surface at any time, the extracted portion of the cable spoils the beauty. When a number of the microphones are used on a table in a TV studio, the beauty is further spoiled.

On the other hand, in order to conceal the extracted cable, a simple reconstruction is added such that the microphone is decomposed and a drawing hole is drilled on the bottom of the microphone case and the extracted cable is directly drawn from the hole. However this reconstruction needs to use tools for processing the microphone case and needs time or skill and further causes failure of the microphone.

SUMMARY OF THE INVENTION

In order to solve the above-described problem, the present invention is carried out. A primary object of the invention is to provide a surface-placed sound capturing microphone with a rotatable cable connecting member of which the extracted cable position can be simply changed as required.

Another object of the invention is to provide a surface-placed sound capturing microphone with a rotatable cable connecting member having a positioning mechanism formed with a simple measure by which the positioning can be achieved.

An additional object is to provide a surface-placed sound capturing microphone with a rotatable cable connecting member in which an output cable extracted to the cable connecting member is not damaged even if the extracted cable position is changed.

A further object of the invention is to provide a surface-placed sound capturing microphone with a rotatable cable connecting member in which a good electric conductivity between the connecting member and the microphone case is obtained in order not to be affected by electric noises invading from the outside of the microphone.

In order to achieve the above-described objects, the surface-placed sound capturing microphone with a rotatable cable connecting member of the invention is placed on a placed plane surface such as a table. It is characterized in that the microphone includes a microphone case housing a microphone capsule therein, the microphone further including the connecting member to which one end of the output cable is connected for transferring an audio signal captured by the microphone capsule to a predetermined external instrument such as an audio mixer, the connecting member including a horizontal rotating shaft in parallel to the placed surface, the connecting member mounted in the microphone case and being rotatable around the horizontal shaft. Whereby the extracted position of the output cable can be simply changed according to aspects to be used.

The cable connecting member has a horizontal and a vertical extracted positions and is so mounted as to rotate and reciprocally move between the both positions. The output cable is horizontally extracted in parallel to the placed surface at the horizontal extracted position and is vertically extracted relating to the placed surface at the vertical extracted position. Whereby, when the microphone is generally used such as in a conference room, the output cable can be horizontally extracted at the horizontal extracted position, and when the extracted cable direction is worried, for example, as used in a TV studio, the cable can be downwards extracted directly to the table with the cable connecting member positioned at the vertical extracted position.

An annular bearing spacer is inserted around the outer circumference of the horizontal rotating shaft of the rotatable case. The rotatable case is rotatablly housed in the microphone case through the bearing spacer. The bearing spacer has a plurality of latching portions and is locked along latching surfaces of a bearing rib mounted in the microphone case so that the movement of the bearing spacer is restricted.

The horizontal rotating shaft has a hollow portion and a U-shaped cutout. The output cable is extracted to the cable connecting member through the hollow portion and the U-shaped cutout so that a movement causing failure such as breaking wire is restricted since the cable extracted in the rotatable case is not twisted even if the rotatable case rotates.

The outer circumference surface of the horizontal rotating shaft has positioning surfaces for positioning the rotatable case at the horizontal and the vertical extracted positions. The microphone case has pushing means formed with a plate spring. The rotatable connecting member can be securely positioned at the horizontal and the vertical extracted positions in cooperation with the positioning surfaces and the plate spring. The plate spring can electrically conduct between the rotatable case and the microphone case and this electric conductivity can restrict electric noises such as electromagnetic wave from the outside of the microphone, that is, the electric shielding function of the microphone can be enhanced.

DETAILED DESCRIPTION OF THE PREFERRED EMBODIMENTS

Figure 1:
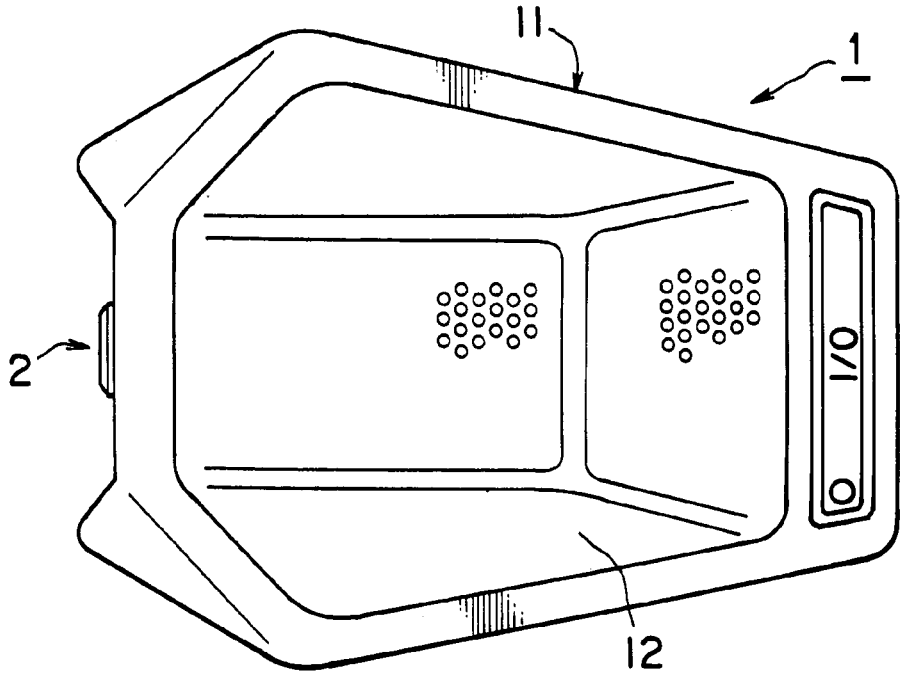
FIG. 1 is a plan view of a surface-placed sound capturing microphone with a rotatable cable connecting member embodying the present invention.
Figure 2:
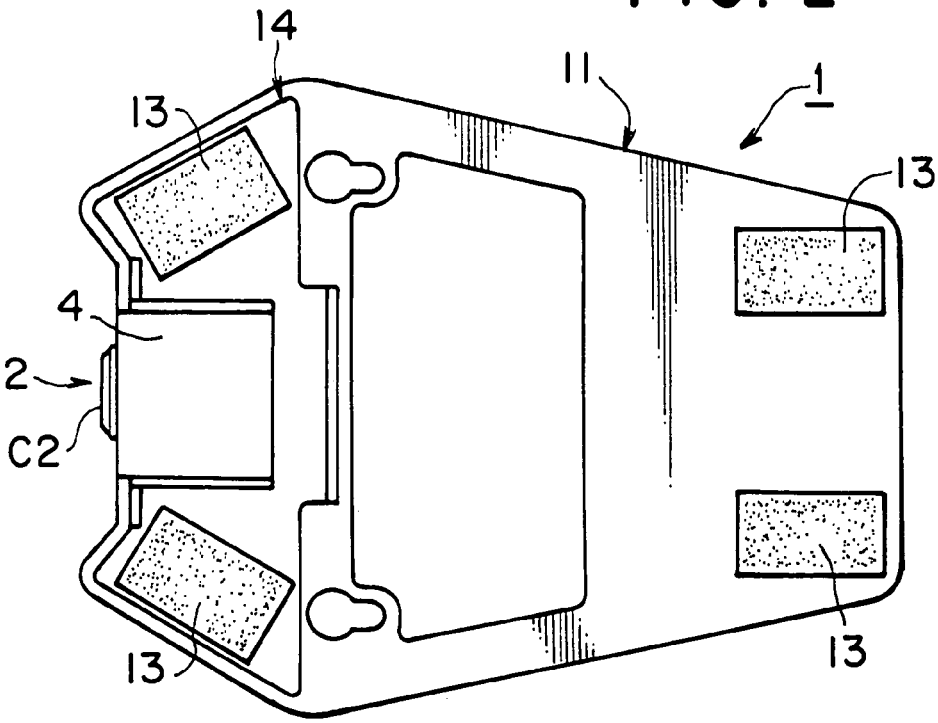
FIG. 2 is a bottom plan view of the microphone embodying the invention.
Figure 3:
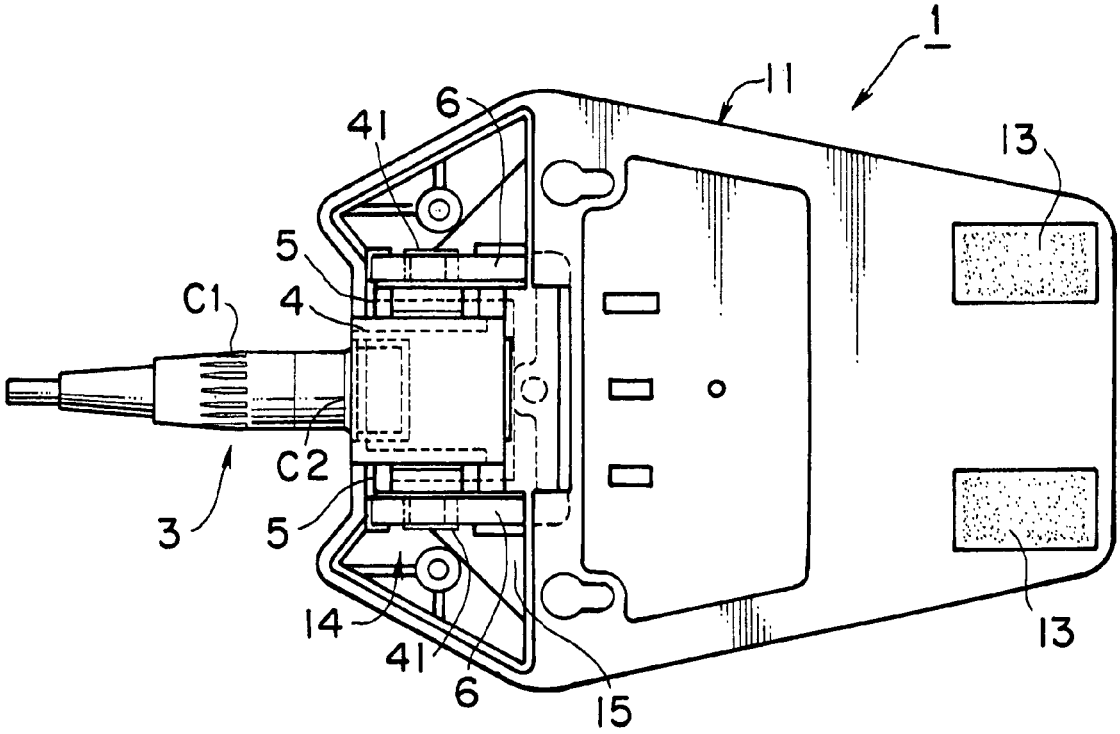
FIG. 3 is a rear plan view of the microphone embodying the invention, as seen with a bottom panel removed.

Referring to drawings, an embodiment of this invention will be described. FIGS. 1 and 2 are, respectively, a plan and a bottom plan views of a surface-placed sound capturing microphone with a rotatable cable connecting member embodying the present invention. FIG. 3 is a rear plan view of the microphone embodying the invention, as seen with a bottom panel removed.

The microphone 1 includes a low profile microphone case 11 which is placed in parallel to a horizontal surface such as a table. The microphone case has a microphone capsule therein which is a capacitor microphone or the like. A cover 12 having a number of through holes communicating with the microphone capsule is mounted on the upper side (the obverse side of FIG. 1 relating to the page space) of the microphone case 11.

The bottom side of the microphone case 11 has an anti-slip member for preventing the case from slipping and a foot member 13 for absorbing a vibration when the case is placed on the surface. In this embodiment the foot member 13 is formed with a cushion body such as expanded synthetic resin. A contacting surface of the foot member 13 to the placed surface such as the surface of a table uses an anti-slip member processed by treating rubber or the like.

A bottom panel 14 is mounted on the bottom side of the microphone case 11 for pushing the connecting member 2 in the microphone case 11. In this embodiment the bottom panel 14 is screwed to the microphone case 11. However, the screw holes (not shown) are concealed by the foot member 13 mounted on the microphone case 11.

In this invention a shape and material of the microphone case 11 are not restricted, however, form the viewpoint of enhancing a shield effect for preventing an electromagnetic wave invading from the outside of the microphone, it is preferable that the microphone case 11 is formed with metal.

Mounted in the back side (the left side in FIG. 3) of the microphone case 11 is a connecting member 2 to which a connector C1 is connected. The connector C1 is connected to one end of an output cable 3 for transferring an acoustic signal captured from the surface-placed sound capturing microphone to an external instrument (not shown) such as an audio-mixer.

According to FIG. 3, the connecting member 2 includes a rotating case 4 having horizontal rotating shafts 41, 41 and bearing spacers 5, 5. Each of the spacers is inserted to each of the horizontal rotating shafts 41, 41 along each of the outer circumferences of the shafts. The connecting member 2 is housed in a housing recess 15 of the microphone case 11.

Referring to FIGS. 4*a*, 4*b*, 4*c* and 5, the rotatable case 4 is an assembly including two rotatable case members 4A and 4B. In this embodiment each of the rotatable case members is formed with synthetic resin.

In this embodiment the rotatable case 4 and the bearing spacer 5 are formed with synthetic resin. However, in consideration of enhancing an electric shielding effect, it is preferable that the case and the spacer are formed with metal. Even if the case and the spacer are molded products, metallic films can be formed on the surfaces thereof by spattering or the like to obtaining electric conductivity of the case and the spacer.

Hereinafter, the rotatable case members 4A and 4B are called a first and a second rotatable case members, respectively. The side of the first case member 4A facing to the second case member 4B is open. The first member is formed in a box-shape with one-end opening. Each of the horizontal shafts 41, 41 protrudes from each of both sides of the first member 4A with the side and the shaft integrated (in the right and left direction in FIG. 4*a*).

Figure 4A:
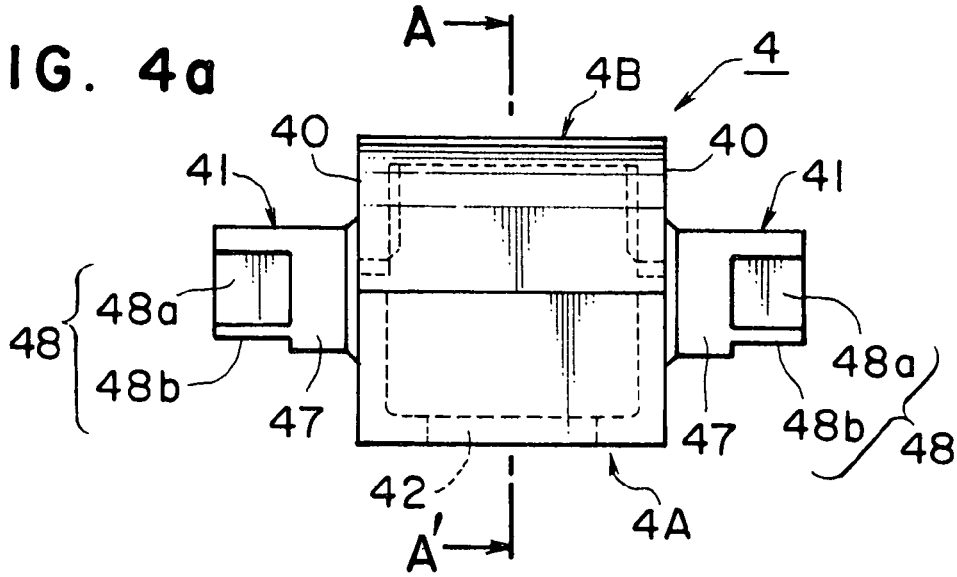
FIGS. 4*a* and 4*b* are a plan view and a front view of a rotatable case of the microphone, respectively.
Figure 4B:
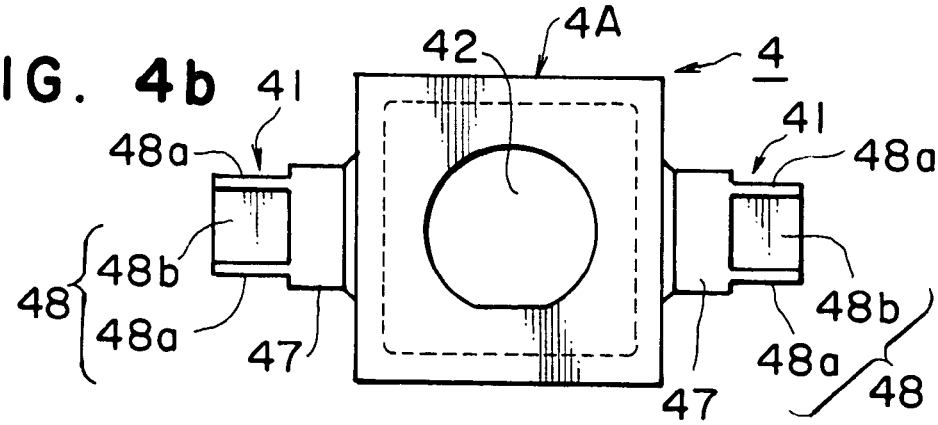
Figure 4C:
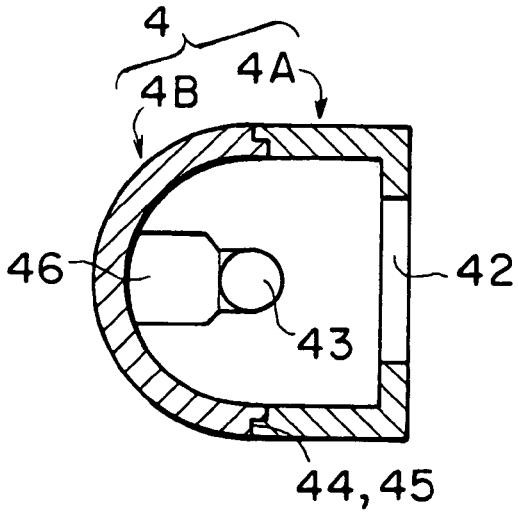
FIG. 4*c* is a cross sectional view of the rotable case of FIG. 4*a* taken along the line A—A.

According to FIG. 4*c*, the bottom (the right side in FIG. 4*c*) of the first rotatable case member 4A has a fixing hole 42. The fixing hole 42 is a mounting hole for fixing the connector terminal C2 receiving a connector C1 of the output cable. The connector terminal C2 is integrally held by the fixing hole.

In the embodiment, male-female screw type connectors of XLRM type are used as the connector C1 and the connector terminal C2.

Figure 5:
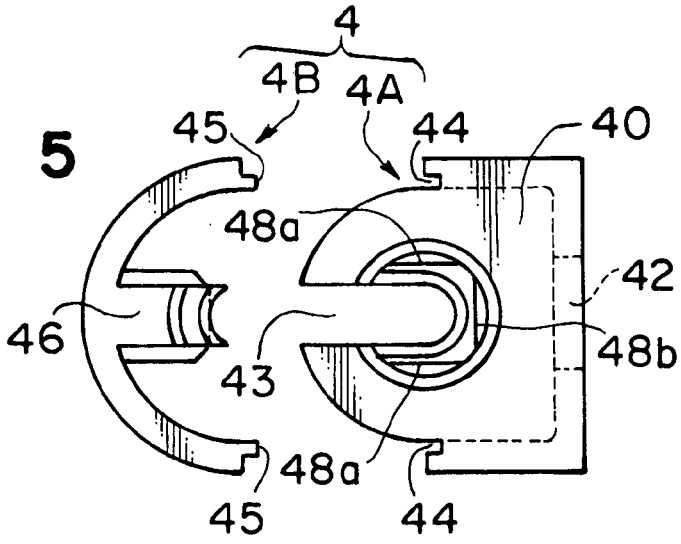
FIG. 5 is an exploded side view illustrating the decomposed rotatable case of the microphone.

According to FIG. 5, an U-shaped cutout 43 is formed to the center from an opening side in each of side walls 40, 40 of the first rotatable case member 4A. One end of a cable connected to the microphone capsule (not shown) passes through the U-shaped cutout 43 and then is drawn to the inside of the rotatable case 4 to connect to the connector terminal C2.

A positioning groove 44 is formed in the circumference of the open end of the first rotatable case member 4A for fitting and aligning with an adequate position of the second rotatabable case member 4B. The groove 44 is formed at a lower level than the outer circumference of the first case member 4A. The groove 44 is engaged with a protrusion 45 of the second case member 4B to position the first and second case members.

The second rotatable case member 4B is a cover body engaged along the open face of the first rotatable case member 4A. The outer circumference surface of the second case member 4B is formed in the shape of circular arc. One part of a housing recess 15 of the microphone case 11 has a circular arc face to fit with the outer circumference surface of the second case member 4B.

Each side of the second case member 4B has each of latching projections 46, 46 which is inserted along each of the U-shaped cutouts 43 of the first case member 4A. The latching projection 46 is formed with a plate which can be inserted to the U-shaped cutout 43 and the length of the projection 46 is so formed as to be shorter than the depth of the U-shaped cutout 43 such that the tip of the projection 46 forms a drawing hole of the wire in one part of the cutout 43.

The horizontal rotating shafts 41, 41 will be described. Since each of the shafts 41, 41 has the same profile and is mounted symmetrically with respect to the rotatable case 4, only one shaft 46 will be described and the description of the other shaft is omitted.

As shown in FIGS. 4*a* and 5, the horizontal rotating shaft 41 is mounted and projected in a predetermined length from each of the both sides 40, 40 of the rotatable case 4 and the center portion of the shaft is cylindrically formed and has the U-shaped cutout 43. The outer circumference surface of the shaft 41 has a shaft portion 47 on which a bearing spacer 5 (described hereinafter) fits and a positing member 48 as positioning means for positioning the fixing hole 42 of the rotatable case 4 to a predetermined rotating position.

The shaft portion 47 protrudes in a predetermined height from the wall side of the rotatable case 4 and the outer circumference of the shaft portion 47 is cylindrically formed. The bearing spacer 5 which is described hereinafter is inserted and fits to the shaft portion 47 along the circumference thereof.

The positioning portion 48 is formed along an inscribed circle of the shaft portion 47. The positioning portion 48 includes a horizontal surface 48*a* and a vertical surface 48*b*. The horizontal surface 48*a* positions the output cable 3 extracted from the fixing hole 42 of the rotatable case 4 with the cable 3 extracted in the horizontal direction relating to the placed surface and vertical surface 48*b* positions the output cable 3 with the cable 3 extracted in the vertical direction relating to the placed surface.

In this embodiment, the horizontal surface 48*a* is so formed as to face to the other horizontal surface as well as the vertical surface 48*b* is so formed as to face to the other vertical surface. This is a reason that the microphone 1 can be used even if the rotatable case 4 is mounted upside-down relating to the microphone case 11, that is, the symmetric structure is employed in this microphone. However, the microphone is sufficient as long as only one horizontal and one vertical surfaces are formed.

The angle between the horizontal and the vertical surfaces 48*a*, 48*b* is approximate 90 degrees. In this embodiment, the positioning portion 48 is formed as a cross sectional rectangular having, respectively, two surfaces of the horizontal and vertical surfaces 48*a*, 48*b*. However, when a finer adjustment of the angle is needed, the minimum range of the angle can be decreased by exchange the cross sectional rectangular to a hexagon or a octagon profiles or the like.

Figure 6A:
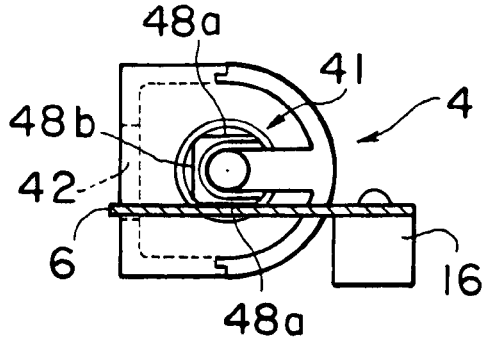
FIGS. 6*a*, 6*b* and 6*c* are views illustrating the relationship between the rotatable case and positioning means.
Figure 6B:
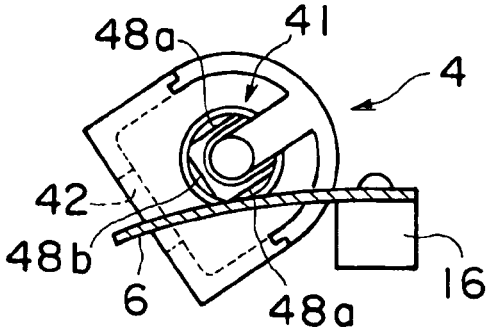
Figure 6C:
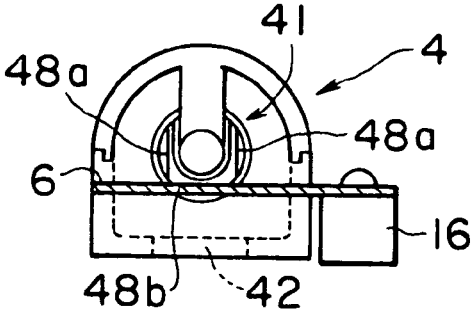

The microphone case 11 has a plate spring as positioning means for positioning the rotatable case 4 to the predetermined position and for fixing the case 4 in cooperation with the positioning portion 48. As shown in FIGS. 6*a*, 6*b* and 6*c*, the plate spring 6 is formed with a metallic plate of which one end is integrally screwed to a top end of a spring fixing member 16 and the other end of the plate spring is free.

The plate spring 6 is held in the state that the spring contacts in parallel to either the horizontal surface 48*a* or the vertical surface 48*b*. Accordingly, as shown in FIG. 6*a*, when the fixing hole 42 horizontally stays, the plate spring 6 contacts to the horizontal surface 48*a* of the positioning portion 48 so that the rotation of the rotatable case 4 can be restricted by spring pressure even if the case 4 is forced by a rotation force.

When the direction of the rotatable case 4 is changed to the vertical direction, as shown in FIG. 6*b*, the case 4 is rotated and the spring is pushed down in the state that the spring pressure can not resist and the positioning portion 48 is rotated. When the case 4 is further rotated, referring to FIG. 6*c*, the spring 6 contacts to the vertical surface 48*b* of the positioning portion 48 and the rotatable case 4 is held vertically.

The plate spring 6 has a function of obtaining an electrical conduct between the case 4 and the microphone case 11 except for the positioning means. An electric shield effect can be enhanced by obtaining the electric conductivity of the microphone 11 itself.

Figure 7:
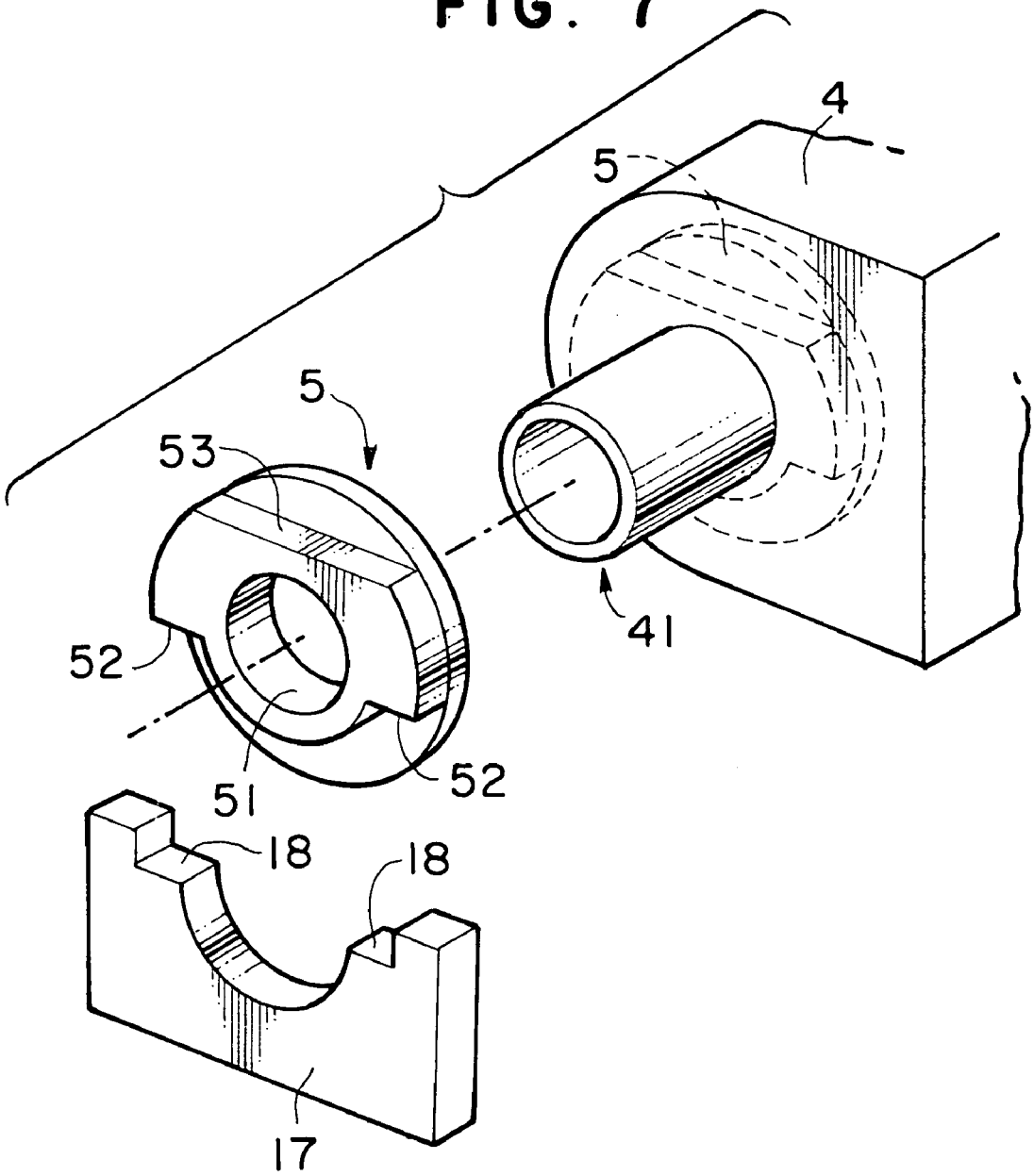
FIG. 7 is a view illustrating a configuration of a bearing spacer and an installation of the spacer to a horizontal rotating shaft.
Figure 8A:
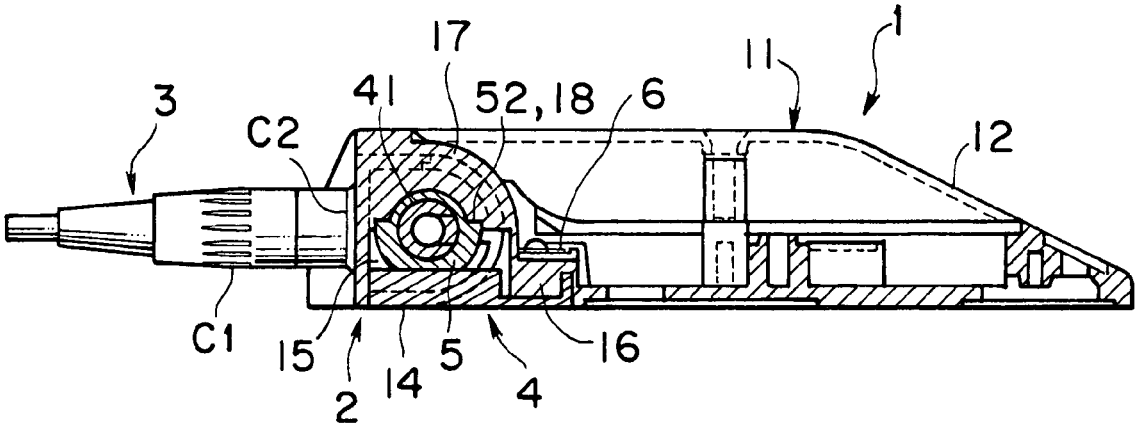
FIG. 8*a* is a cross sectional view illustrating the microphone, as seen with the rotatable case positioned at the horizontal extracted direction.
Figure 8B:
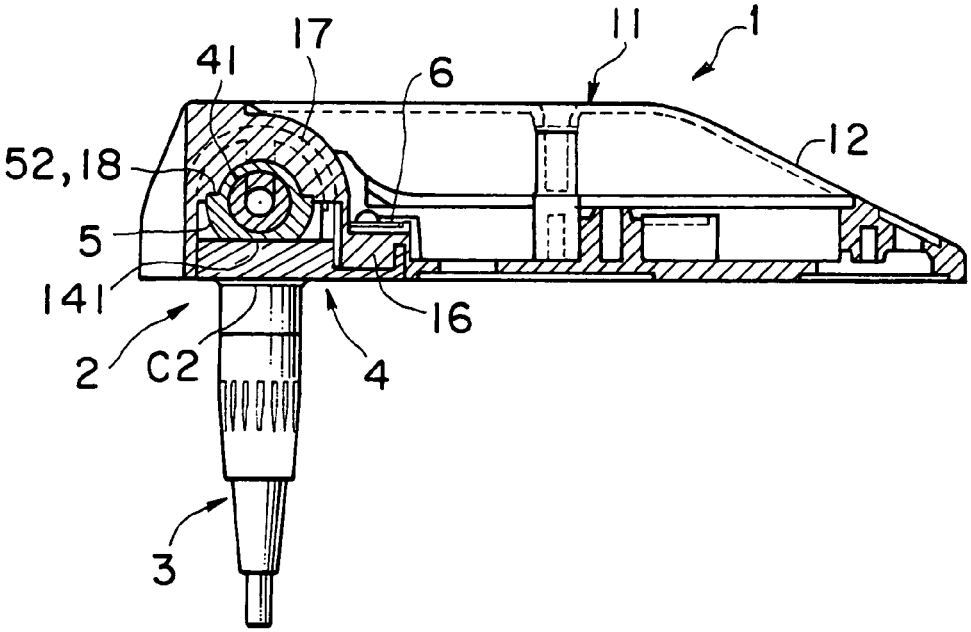
FIG. 8*b* is a cross sectional view illustrating the microphone, as seen with the rotatable case positioned at the vertical extracted direction.

Referring to FIGS. 7, 8*a* and 8*b*, the bearing spacer 5 mounted to the horizontal shaft 41 will be described. The horizontal rotating shaft 41 in FIG. 7 is illustrated as a simple cylinder because of a view illustrating a configuration of the bearing spacer and an installation of the spacer to the horizontal rotating shaft. The bearing spacer 5 is formed with a disc body of which the center portion has a penetrated hole 51 penetrated by the horizontal rotating shaft 41.

One end of the bearing spacer 5 has latching portions 52, 53 to prevent a rotation of the spacer 5. Each of the latching portions 52 has a step surface which is axially projected from the side of the spacer 5. Each of the latch portions 52 is locked to each of latching surfaces 18 of a bearing rib 17 mounted in the microphone case 11 so that a movement of the spacer 5 is restricted.

The other latching portion 53 has a second step surface placed at the opposite side of the latching portion 52 relating to the penetrated hole 51. The latching portion 53 contacts to a top end of a latching rib 141 (referring to FIG. 8*b*) formed in one part of the bottom panel 14 which is mounted on the bottom of the microphone case 11.

As shown in FIGS. 8*a* and 8*b*, the rotatable case 4 is rotatablly fixed to the housing recess 15 of the microphone case 11 through the bearing spacer 5. The case 4 can rotate without direct contact between the rotatable case 4 and the microphone case 11 so that durability and reliability of the microphone 1 is increased and the rotatable case 4 is securely housed in the microphone case 11 through the bearing spacer 5.

Referring to FIGS. 8*a* and 8*b*, one example of a procedure for using the microphone 1 will be described. When the microphone 1 needs to be placed with the output cable 3 extracted in parallel relating to the placed face (horizontal extracting position), the microphone 1 is placed in the state that the connector terminal C2 is horizontally hold.

When the microphone 1 needs to be placed with the output cable 3 extracted vertically relating to the placed face (vertical extracting position), the rotatable case 4 is rotated to the position where the connector 2 faces downwards so that the inserting position of the connector terminal C2 can be changed to the vertical position (vertical extracting position). In this case an extracted hole or a recess or the like is required to be mounted in the placed surface in order to draw the output cable 3 downwards.

In this embodiment described above, the output cable 3 is connected to the microphone case 11 through the connector C1 and the connector terminal C2. However, another aspect that, for example, a cord bush is mounted in the fixing hole 42 and the output cable 3 is directly drawn to the microphone case 11 without connectors C1, C2 is included in this invention the other aspects are included in this art of this invention as long as the rotation mechanism of this invention is employed.

The invention claimed is:

1. A microphone comprising a permanent microphone housing the housing having a substantially flat planar bottom surface extending from a front end to a rear end of the microphone, the microphone supported on a conforming horizontal planar surface and having a connecting member at one end of an output cable for transferring audio signals of the microphone to an external audio instrument a rotatable joint having a right and a left side wall, the rotatable joint being completely within the housing and connected to the connecting member;

a horizontal shaft secured between said right and left side walls of the rotatable joint in parallel to the flat planar bottom surface; and the connecting member mounted on said shafts for pivotal motion thereabout, while maintaining contact of the flat planar bottom face surface with the horizontal planar surface.

2. A microphone according to claim 1, wherein the connecting member has a horizontal position with an output cable horizontally located in parallel to the horizontal planar surface and a vertical position with the output cable vertically located relating to the horizontal planar surface, the connecting member capable of reciprocal movement between the horizontal and the vertical positions.

3. A microphone according to claim 1, wherein each of the connecting member has a horizontal shaft of the rotatable joint is supported by an annular bearing spacer and the rotatable joint is rotatablly housed in the connecting member of the microphone through the annular bearing spacer.

4. A microphone according to claim 3, wherein the annular bearing spacer have a plurality of latching portions and are locked along latching surfaces of a bearing rib mounted in the connecting member so that the movement of the annular bearing spacer is restricted.

5. A microphone according to claim 1, wherein the horizontal shaft of the rotatable joint has positioning surfaces for securing the rotatable joint in a horizontal or the vertical positions.

6. A microphone according to claim 5, wherein the connecting member joint has pushing means for pushing the positioning surfaces.

7. A microphone according to claim 6, wherein the pushing means includes a plate spring and the plate spring securely positions the connecting member a horizontal or a vertical position in cooperation with one of the positioning surfaces the plate spring electrically connecting the rotatable joint to the housing.

8. A microphone according to claim 1, wherein the horizontal rotating shafts has a hollow portion and a U-shaped cutout, and the output cable is connected to the rotatable joint through the hollow portion and connected to the connecting member without the ouput cable being damaged during the pivotal motion.

* * * * *